US007775783B2

(12) United States Patent
Kakuda et al.

(10) Patent No.: US 7,775,783 B2
(45) Date of Patent: Aug. 17, 2010

(54) REFRIGERATION SYSTEM INCLUDING A SCROLL EXPANDER

(75) Inventors: Masayuki Kakuda, Tokyo (JP); Shin Sekiya, Tokyo (JP); Toshihide Koda, Tokyo (JP); Masahiro Sugihara, Hyogo (JP)

(73) Assignee: Mitsubishi Electric Corporation, Tokyo (JP)

( * ) Notice: Subject to any disclaimer, the term of this patent is extended or adjusted under 35 U.S.C. 154(b) by 193 days.

(21) Appl. No.: 11/816,946

(22) PCT Filed: Jan. 26, 2006

(86) PCT No.: PCT/JP2006/301204

§ 371 (c)(1),
(2), (4) Date: Aug. 23, 2007

(87) PCT Pub. No.: WO2006/103821

PCT Pub. Date: Oct. 5, 2006

(65) Prior Publication Data

US 2008/0298992 A1 Dec. 4, 2008

(30) Foreign Application Priority Data

Mar. 29, 2005 (JP) ..... 2005-094705

(51) Int. Cl.

| | |
|---|---|
| ***F01C 1/02*** | (2006.01) |
| ***F01C 13/04*** | (2006.01) |
| ***F04C 18/02*** | (2006.01) |
| ***F04C 23/00*** | (2006.01) |
| ***F04C 23/02*** | (2006.01) |
| ***F25B 1/00*** | (2006.01) |

(52) U.S. Cl. ..... 418/55.4; 418/55.5; 418/60; 418/142; 62/116; 62/498

(58) Field of Classification Search ..... 418/55.1, 418/55.4, 55.5, 58, 60, 104, 142; 62/116, 62/498

See application file for complete search history.

(56) References Cited

U.S. PATENT DOCUMENTS

| | | | | |
|---|---|---|---|---|
| 5,035,589 | A * | 7/1991 | Fraser et al. | 418/55.4 |
| 6,425,746 | B1 * | 7/2002 | Mori et al. | 418/55.4 |
| 6,439,864 | B1 * | 8/2002 | Shaffer | 418/55.4 |
| 6,464,467 | B2 * | 10/2002 | Sullivan et al. | 418/60 |
| 6,506,512 | B1 | 1/2003 | Mori et al. | |
| 6,551,081 | B2 * | 4/2003 | Nakane et al. | 418/55.4 |

(Continued)

FOREIGN PATENT DOCUMENTS

| | | |
|---|---|---|
| JP | 3-59355 | 3/1991 |

(Continued)

*Primary Examiner*—Thomas E Denion
*Assistant Examiner*—Mary A Davis
(74) *Attorney, Agent, or Firm*—Leydig, Voit & Mayer, Ltd.

(57) ABSTRACT

A scroll expander that is efficient in a wide range of operating conditions by suppressing leakage loss and decreasing in recovered power using a simple construction includes: an expansion mechanism, including an orbiting scroll and a first fixed scroll, recovers power by expanding a refrigerant; and an auxiliary compression mechanism, including an orbiting scroll and a second fixed scroll, compresses a refrigerant using power recovered by the expansion mechanism. A tip seal is mounted only on a spiral tooth of an orbiting scroll and a fixed scroll of one of the expansion mechanism or the auxiliary compression mechanism.

8 Claims, 7 Drawing Sheets

U.S. PATENT DOCUMENTS

| | | | | |
|---|---|---|---|---|
| 6,658,866 | B2 * | 12/2003 | Tang et al. | 418/60 |
| 2001/0043878 | A1 * | 11/2001 | Sullivan et al. | 418/55.4 |
| 2003/0000238 | A1 * | 1/2003 | Uchida et al. | 62/323.4 |
| 2005/0031469 | A1 | 2/2005 | Yanagisawa et al. | |

FOREIGN PATENT DOCUMENTS

| | | | |
|---|---|---|---|
| JP | 7-208353 | | 8/1995 |
| JP | 7-310682 | | 11/1995 |
| JP | 07310682 | A * | 11/1995 |
| JP | 2001-093553 | | 4/2001 |
| JP | 2001-271765 | | 10/2001 |
| JP | 2001-355588 | | 12/2001 |
| JP | 2003-343203 | | 12/2003 |
| JP | 2004-257303 | | 9/2004 |
| JP | 2004257303 | A * | 9/2004 |
| JP | 2005-48654 | | 2/2005 |

* cited by examiner (a)

(b)

REFRIGERATION SYSTEM INCLUDING A SCROLL EXPANDER

TECHNICAL FIELD

The present invention relates to a scroll expander in which power is recovered by expanding a refrigerant and is used in compression.

BACKGROUND ART

In conventional scroll expanders, a compression chamber of a compressing means is formed by a first fixed scroll and an orbiting scroll, and at the same time, an expansion chamber of an expanding means is formed by a second fixed scroll and the orbiting scroll. The orbiting scroll is linked to a crankshaft, and is configured so as to be driven to revolve by a motor mounted to the crankshaft (see Patent Literature 1, for example).

Patent Literature 1: Japanese Patent Publication No. HEI 07-037857 (Gazette: pp 3-4; FIG. 1)

DISCLOSURE OF THE INVENTION

Problem to be Solved by the Invention

However, scroll expanders such as that described above have had to be configured integrally with driving sources such as the motor, etc., making construction complicated. Another problem has been that recovered power is reduced in off-design point operating conditions since quantity of flow or differential pressure of the expansion mechanism must be reduced in order to synchronize the rotational frequencies of the expansion mechanism and the compression mechanism. An additional problem has been that leakage at tip of spiral teeth cannot be suppressed because the expansion chamber and the compression chamber are disposed on two surfaces of the orbiting scroll (pivoting scroll).

The present invention aims to solve the above problems and an object of the present invention is to provide a scroll expander that is efficient in a wide range of operating conditions by suppressing leakage loss and decreases in recovered power using a simple construction.

Means For Solving Problem

According to one aspect of the present invention, there is provided a scroll expander including: an expansion mechanism that is constituted by an orbiting scroll and a first fixed scroll, and that recovers power by expanding a refrigerant; and an auxiliary compression mechanism that is constituted by an orbiting scroll and a second fixed scroll, and that compresses refrigerant using power recovered by the expansion mechanism, characterized in that a tip seal is mounted only to a spiral tooth of an orbiting scroll and a fixed scroll of one of either the expansion mechanism or the auxiliary compression mechanism.

According to another aspect of the present invention, there is provided a scroll expander including: an expansion mechanism that is constituted by an orbiting scroll and a first fixed scroll, and that recovers power by expanding a refrigerant; and an auxiliary compression mechanism that is constituted by an orbiting scroll and a second fixed scroll, and that undertakes a portion of a compression process of a refrigerating cycle by compressing refrigerant using power recovered by the expansion mechanism, characterized in that a tip seal is mounted only to a spiral tooth of an orbiting scroll and a fixed scroll of one of either the expansion mechanism or the auxiliary compression mechanism.

EFFECTS OF THE INVENTION

The present invention can provide a scroll expander that is efficient in a wide range of operating conditions by suppressing leakage loss and decreases in recovered power using a simple construction.

BEST MODE FOR CARRYING OUT THE INVENTION

Embodiment 1

Figure 1:
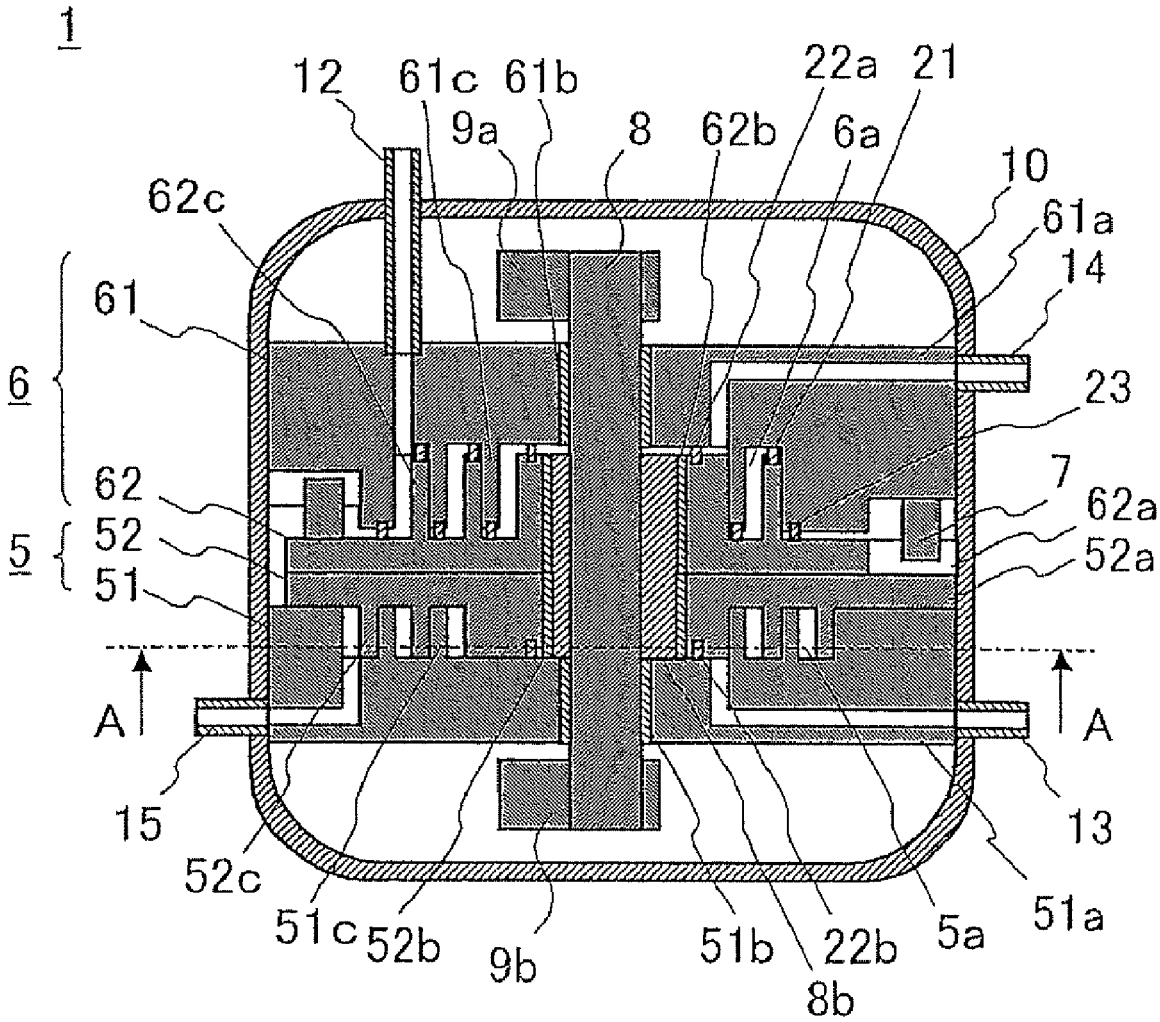
FIG. 1 is a longitudinal section showing configuration of a scroll expander according to Embodiment 1 of the present invention.

FIG. 1 is a longitudinal section showing configuration of a scroll expander according to Embodiment 1 of the present invention. In the figure, portions allocated identical numbering are identical or correspond to each other, and this will be constant throughout the specification.

In FIG. 1, an expansion mechanism 5 is installed in a lower portion inside a sealed vessel 10 of a scroll expander 1, and an auxiliary compression mechanism 6 is installed above the expansion mechanism 5. The expansion mechanism 5 is constituted by: a fixed scroll 51 (first fixed scroll) having a spiral tooth 51*c* formed on a base plate 51*a*; and an orbiting scroll 52 having a spiral tooth 52*c* formed on a base plate 52*a*, the spiral tooth 51*c* of the fixed scroll 51 and the spiral tooth 52*c* of the orbiting scroll 52 being disposed so as to mesh with each other. The auxiliary compression mechanism 6 is constituted by: a fixed scroll 61 (second fixed scroll) having a spiral tooth 61*c* formed on a base plate 61*a*; and an orbiting scroll 62 having a spiral tooth 62*c* formed on a base plate 62*a*, the spiral tooth 61*c* of the fixed scroll 61 and the spiral tooth 62*c* of the orbiting scroll 62 being disposed so as to mesh with each other.

A shaft 8 is held rotatably at two ends by shaft bearing portions 51*b* and 61*b* that are formed centrally on the fixed scroll 51 of the expansion mechanism 5 and the fixed scroll 61 of the auxiliary compression mechanism 6, respectively. Eccentric shaft bearing portions 52*b* and 62*b* that are formed centrally on the orbiting scroll 52 of the expansion mechanism 5 and the orbiting scroll 62 of the auxiliary compression mechanism 6, respectively, are penetrated and supported by a crank portion 8*b* fitted onto the shaft 8 so as to enable pivoting motion.

An expansion suction pipe 13 that sucks in refrigerant and an expansion discharge pipe 15 that discharges expanded refrigerant are installed on side surfaces of the sealed vessel 10 outside the expansion mechanism 5. Similarly, an auxiliary compression suction pipe 12 that sucks in refrigerant is installed on an upper surface of the sealed vessel 10 above the auxiliary compression mechanism 6, and an auxiliary compression discharge pipe 14 that discharges compressed refrigerant is installed on a side surface of the sealed vessel 10 outside the auxiliary compression mechanism 6.

In the auxiliary compression mechanism 6, tip seals 21 that partition off an auxiliary compression chamber 6*a* that is formed by the spiral tooth 61*c* of the fixed scroll 61 and the spiral tooth 62*c* of the orbiting scroll 62 are mounted onto tips of the spiral teeth 61*e* and 62*c* of the fixed scroll 61 and the orbiting scroll 62, respectively. An inner seal 22*a* that forms a seal between the orbiting scroll 62 and the fixed scroll 61 is disposed outside the eccentric shaft bearing portion 62*b* of the orbiting scroll 62 on a surface that faces the fixed scroll 61. In addition, an outer seal 23 that forms a seal between the orbiting scroll 62 and the fixed scroll 61 is disposed outside the spiral tooth 61*c* of the fixed scroll 61 on a surface that faces the orbiting scroll 52.

Similarly, in the expansion mechanism 5, an inner seal 22*b* that forms a seal between the orbiting scroll 52 and the fixed scroll 51 in a similar manner to the auxiliary compression mechanism 6 is disposed outside the eccentric shaft bearing portion 52*b* of the orbiting scroll 52 on a surface that faces the fixed scroll 51. However, tip seals 21 are not mounted to tips of the spiral teeth 51*c* and 52*c* of the fixed scroll 51 and the orbiting scroll 52. Nor is an outer seal 23 disposed outside the spiral tooth 51*c* in the fixed scroll 51 on a surface that faces the orbiting scroll 52.

The orbiting scroll 52 of the expansion mechanism 5 and the orbiting scroll 62 of the auxiliary compression mechanism 6 are integrated by bonding elements such as pins, etc., and autorotation is corrected by an Oldham ring 7 that is disposed on the auxiliary compression mechanism 6. Counterweights 9*a* and 9*b* are mounted to two ends of the shaft 8 in order to cancel out centrifugal force that is generated by the pivoting motion of the orbiting scrolls 52 and 62. Moreover, the orbiting scroll 52 of the expansion mechanism 5 and the orbiting scroll 62 of the auxiliary compression mechanism 6 may also be formed integrally in a shape in which the base plates 52*a* and 62*a* are shared.

In the expansion mechanism 5, power is generated inside the expansion chamber 5*a* that is formed by the spiral tooth 51*c* of the fixed scroll 51 and the spiral tooth 52*c* of the orbiting scroll 52 by expansion of high-pressure refrigerant that has been sucked in through the expansion suction pipe 13. Refrigerant that has expanded inside the expansion chamber 5*a* and decompressed is discharged outside the sealed vessel 10 through the expansion discharge pipe 15. Refrigerant sucked in through the auxiliary compression suction pipe 12 is compressed and pressurized inside the auxiliary compression chamber 6*a* that is formed by the spiral tooth 61*c* of the fixed scroll 61 and the spiral tooth 62*c* of the orbiting scroll 62 of the auxiliary compression mechanism 6 by the power generated in the expansion mechanism 5. Refrigerant that has been compressed and pressurized inside the auxiliary compression chamber 6*a* is discharged outside the sealed vessel 10 through the auxiliary compression discharge pipe 14.

Figure 2:
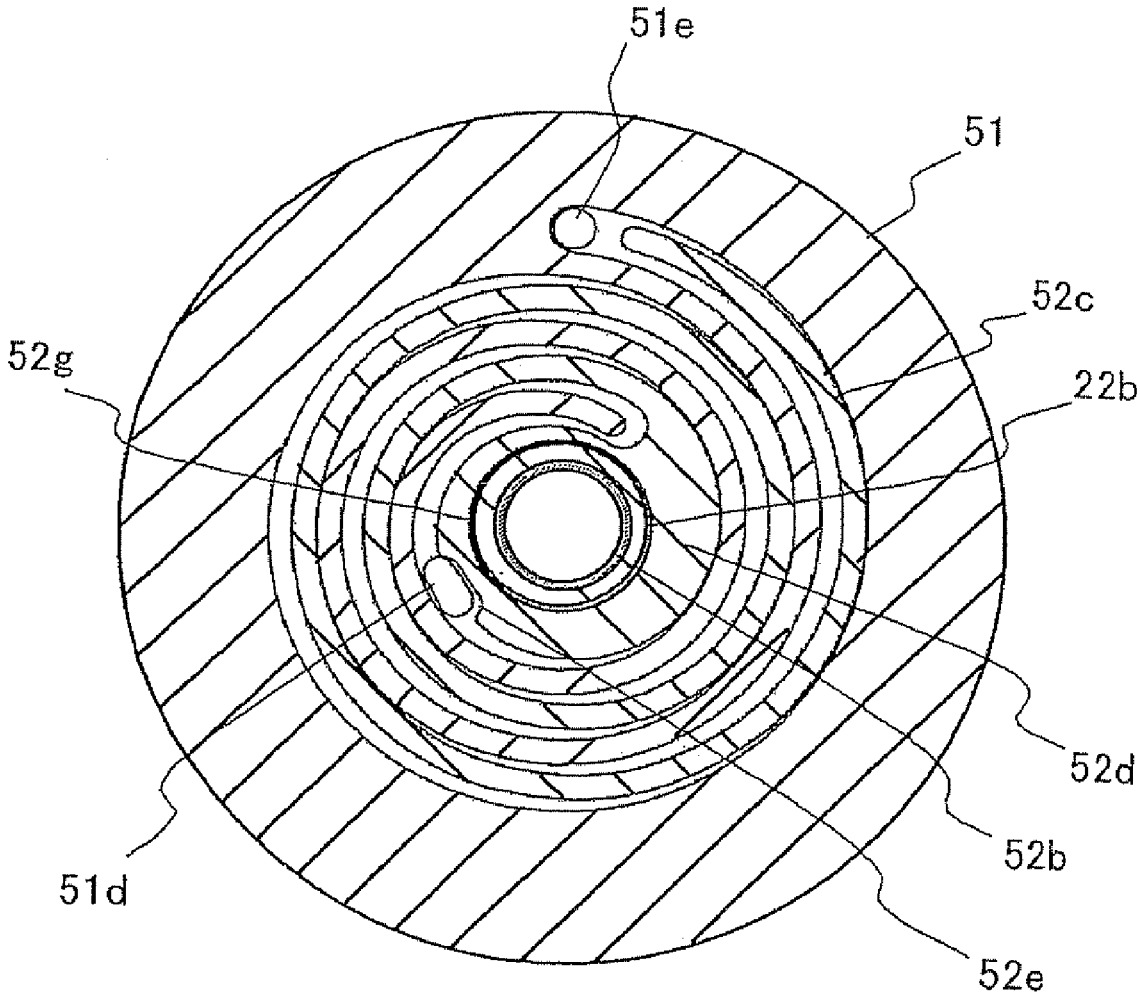
FIG. 2 is a lateral section of an expansion mechanism of the scroll expander according to Embodiment 1 of the present invention.

FIG. 2 is a cross section along line A-A of an expansion mechanism of the scroll expander according to Embodiment 1 of the present invention shown in FIG. 1.

A thick portion 52*d* is disposed on an inner end portion of the spiral tooth 52*c* of the orbiting scroll 52, and the eccentric shaft bearing portion 52*b* into which the crank portion 8*b* is inserted is formed so as to pass through the thick portion 52*d*. An inner seal groove 52*g* is formed on the base plate 52*a* of the orbiting scroll 52 outside the eccentric shaft bearing portion 52*b*, and the inner seal 22*b* is mounted into the inner seal groove 52*g*.

A suction port 51*d* for sucking in refrigerant and a discharge port 51*e* for discharging refrigerant are opened through the base plate 51*c* of the fixed scroll 51. The suction port 51*d* has a generally elongated slot shape in order to ensure aperture area, and is connected to the expansion suction pipe 13. A notched portion 52*e* is also disposed on the thick portion 52*d* in order to reduce blocked area of the suction port 51*d* during the pivoting motion. The discharge port 51*e* is opened at a position that does not interfere with the outer end portion of the spiral tooth 52*c* of the orbiting scroll 52, and is connected to the expansion discharge pipe 15.

Figure 3:
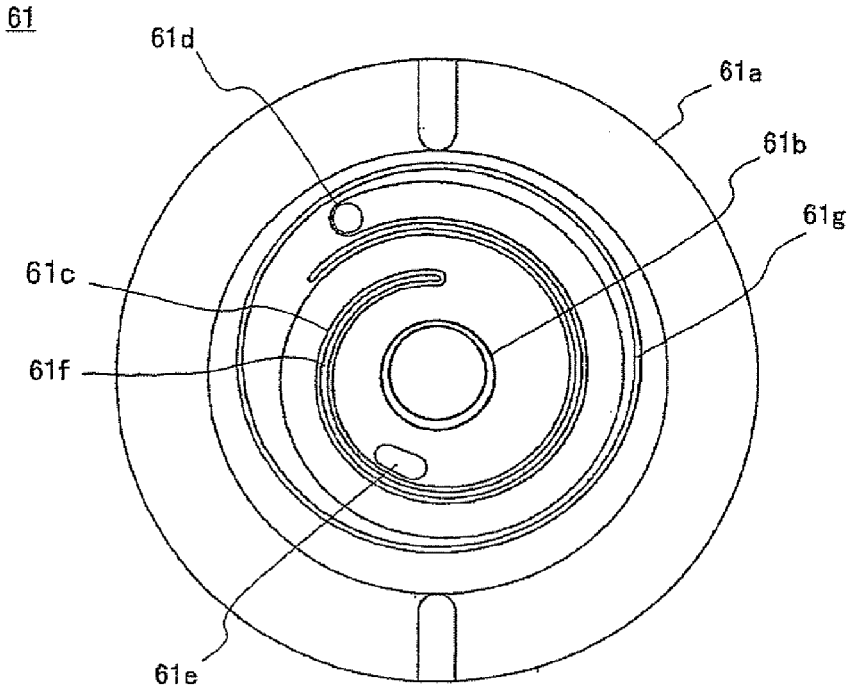
FIG. 3 is a plan showing an auxiliary compression mechanism of the scroll expander according to Embodiment 1 of the present invention.
Figure 3:
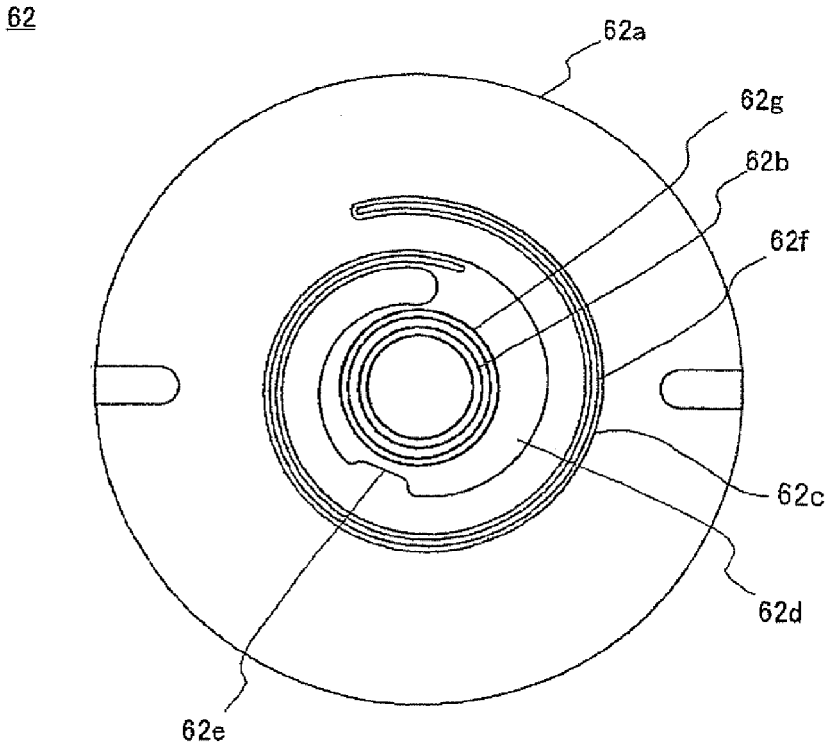

FIG. 3 is a plan showing an auxiliary compression mechanism of the scroll expander according to Embodiment 1 of the present invention, FIG. 3(*a*) being a plan of the fixed scroll of the auxiliary compression mechanism and FIG. 3(*b*) being a plan of the orbiting scroll of the auxiliary compression mechanism. As shown in FIG. 3, the spiral teeth 61*c* and 62*c* of the auxiliary compression mechanism 6 have a winding direction identical to that of the expansion mechanism 5 such that when the orbiting scroll 62 is integrated so as to be back to back with the orbiting scroll 52 of the expansion mechanism 5 and performs the pivoting motion, compression can occur in the former and expansion in the latter.

In a similar manner to the orbiting scroll 52 of the expansion mechanism 5, the eccentric shaft bearing portion 62*b* into which the crank portion 8*b* is inserted is formed so as to pass through a thick portion 62*d* of the orbiting scroll 62, and a suction port 61*d* for sucking in refrigerant and a discharge port 61*e* for discharging refrigerant are opened through the base plate 61*a* of the fixed scroll 61. The discharge port 61*e* has a generally elongated slot shape in order to ensure aperture area, and is connected to the auxiliary compression discharge pipe 14. A notched portion 62*e* is also disposed on the thick portion 62*d* in order to reduce blocked area of the discharge port 61*e* during the pivoting motion. The suction port 61*d* is opened at a position that does not interfere with the outer end portion of the spiral tooth 62*c* of the orbiting scroll 62, and is connected to the auxiliary compression suction pipe 12.

Tip seal grooves 61*f* and 62*f* for mounting the tip seals are formed on tip surfaces of the spiral teeth 61*c* and 62*c*. An inner seal groove 62*g* for mounting the inner seal 22*a* is formed on the base plate 62*a* of the orbiting scroll 62 outside the eccentric shaft bearing portion 62*b*. An outer seal groove 61*g* for mounting the outer seal 23 is formed on the base plate 61*a* of the fixed scroll 61 outside the spiral tooth 61*c*.

Figure 4:
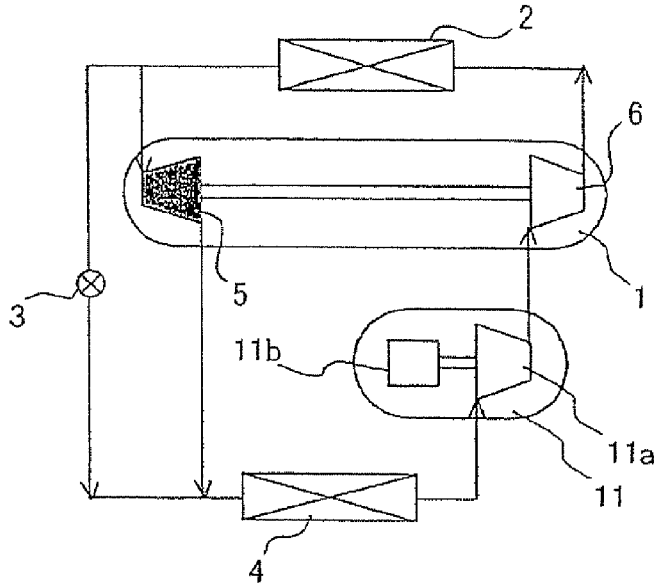
FIG. 4 is a circuit diagram showing basic configuration of a refrigerating cycle using. the scroll expander according to Embodiment 1 of the present invention.

FIG. 4 is a circuit diagram showing basic configuration of a refrigerating cycle using the scroll expander according to Embodiment 1 of the present invention. In Embodiment 1 of the present invention, it is assumed that a refrigerant having a high-pressure side that is supercritical, such as carbon dioxide, is used.

In FIG. 4, a main compression mechanism 11*a* that is driven by an electrically powered mechanism 11*b* of a main compressor 11 is installed in a stage preceding the auxiliary compression mechanism 6 that is driven by the expansion mechanism 5 of the scroll expander 1, and an evaporator 4 that heats the refrigerant is installed in a stage preceding the main compression mechanism 11*a*. On the other hands a gas cooler 2 that cools the refrigerant is installed in a stage subsequent to the auxiliary compression mechanism 6, and the expansion mechanism 5 of the scroll expander 1 and an expansion valve 3 are disposed in parallel in a stage subsequent to the gas cooler 2.

Refrigerant that has been pressurized in the main compression mechanism 11*a* of the main compressor 11 is pressurized further by the auxiliary compression mechanism 6 of the scroll expander 1. Refrigerant that has been pressurized in the auxiliary compression mechanism 6 is cooled by the gas cooler 2, then a portion is sent to the expansion mechanism 5 of the scroll expander 1 to be expanded and decompressed. The expansion valve 3 is disposed in parallel with the expansion mechanism 5 of the scroll expander 1 in order to adjust quantities of flow passing through the expansion mechanism 5 and to ensure differential pressure at startup, and the remaining refrigerant is sent to the expansion valve 3 to be expanded and decompressed. In the expansion mechanism 5, the refrigerant expands isentropically, and expansion power is transmitted from the expansion mechanism 5 through the main shaft 8 to the auxiliary compression mechanism 6 and is used for auxiliary compression work. Refrigerant that has been expanded in the expansion mechanism 5 is heated by the evaporator 4, then returns to the main compression mechanism 11*a* of the main compressor 11.

Figure 5:
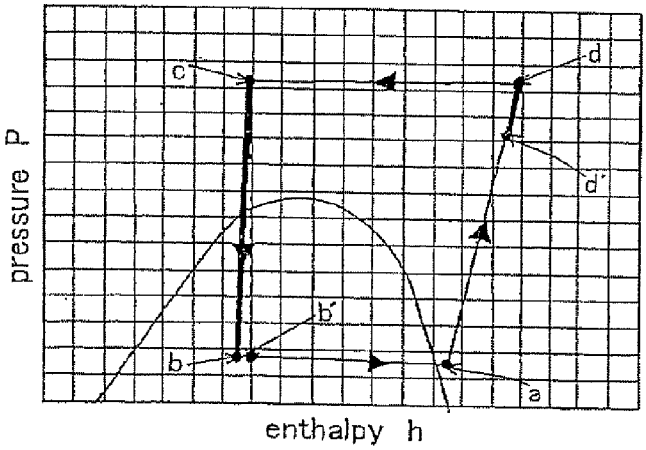
FIG. 5 is a Mollier diagram showing changes in quantities of state of a refrigerant in the refrigerating cycle using the scroll expander according to Embodiment 1 of the present invention.

FIG. 5 is a Mollier diagram showing changes in quantities of state of a refrigerant in the refrigerating cycle using the scroll expander according to Embodiment 1 of the present invention. In FIG. 5, the vertical axis is pressure P, and the horizontal axis is enthalpy h.

As shown in FIG. 5, refrigerant that has been cooled from point d to point c by exchanging heat in the gas cooler 2, expands isenthalpically in a decompression mechanism formed by a restrictor such as an expansion valve as indicated by point c to point b'. However, this becomes point c to point b in the expansion mechanism 5 due to isentropic expansion. For this reason, an amount proportionate to a difference $h_b'$-$h_b$ between enthalpy $h_b'$ at point b' and enthalpy $h_b$ at point b can be recovered as expansion power. After expansion, heat is exchanged in the evaporator 4, and refrigerant gas that has been heated from point b to point a is compressed from point a to point d' by the main compression mechanism 11*a* of the main compressor 11, then compressed from point d' to point d by the auxiliary compression mechanism 6 of the scroll expander 1. As described above, in Embodiment 1 of the present invention, a portion of the compression process of the refrigerating cycle is undertaken by the compression mechanism 11*b* of the main compressor 11, and a remainder of the compression process is undertaken by the auxiliary compression mechanism 6 of the scroll expander 1. Compression power proportionate to the difference in enthalpy $h_d$-$h_d'$ in the auxiliary compression mechanism 6 is provided by recovered power proportionate to $h_b'$-$h_b$.

Figure 6:
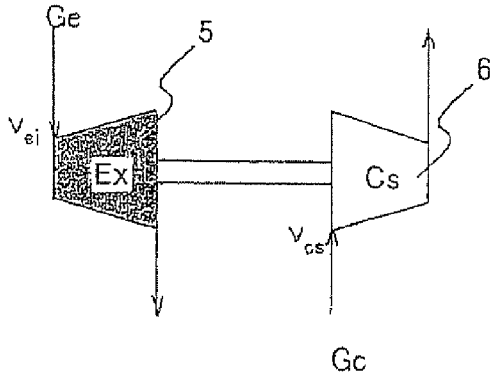
FIG. 6 is a schematic diagram for explaining a relationship between quantity of flow and rotational frequency in general expansion-compression mechanisms.

FIG. 6 is a schematic diagram for explaining a relationship between quantity of flow and rotational frequency in general expansion-compression mechanisms.

As shown in FIG. 6, when there is an auxiliary compression mechanism 6 that is driven by an expansion mechanism 5, if we let quantity of mass flow of refrigerant passing through the expansion mechanism 5 be Ge, quantity of through flow at the auxiliary compression mechanism 6 be Gc, suction stroke volume of the expansion mechanism 5 be Vei, and suction stroke volume of the auxiliary compression mechanism 6 be Vcs, and let refrigerant specific volume at the entrance of the expansion mechanism 5 be $v_{ei}$, and refrigerant specific volume at the entrance of the compression mechanism Cs be $v_{cs}$, then rotational frequency $N_E$ determined by the expansion mechanism 5 can be expressed as in Mathematical Formula 1.

$$N_E = \frac{Gev_{ei}}{Vei} \tag{1}$$

Rotational frequency $N_C$ at the auxiliary compression mechanism 6 can be expressed as in Mathematical Formula 2.

$$N_C = \frac{Gcv_{cs}}{Vcs} \tag{2}$$

Consequently, since $N_E$=$N_C$ is a condition for matching the rotational frequencies of the expansion mechanism 5 and the auxiliary compression mechanism 6, Mathematical Formula 3 must be satisfied.

$$\frac{Gev_{ei}}{Gcv_{cs}} = \frac{Vei}{Vcs} = \sigma_{vec} \tag{3}$$

A ratio of stroke volumes $\sigma_{vec}$ of the expansion mechanism 5 and the auxiliary compression mechanism 6 shown in Mathematical Formula 3 is constant if equipment dimensions are fixed relative to certain design conditions. If operating outside the design conditions, it becomes necessary to adjust a ratio between quantities of volume flow ($Gev_{ei}/Gcv_{cs}$) so as to satisfy Mathematical Formula 3. If all of the compression process of the refrigerating cycle is undertaken by the auxiliary compression mechanism 6 (in that case, it is necessary to use a separate driving source for the auxiliary compression mechanism 6 in addition to the recovered power from the expansion mechanism 5), because specific volumes $v_{ei}$ and $v_{cs}$ at the entrances of the expansion mechanism 5 and the auxiliary compression mechanism 6, respectively, are determined by the operating conditions, the quantity of mass flow Ge is normally adjusted by a means such as a bypass like the expansion valve 3, etc. Here, because the quantity of flow that is made to bypass is a quantity of non-recoverable flow from which expansion power cannot be recovered and effective power recovery decreases, it is necessary to suppress the quantity of bypass flow as much as possible.

As shown in FIG. 5, if a portion (point a to point d') of the compression process of the refrigerating cycle is undertaken by the main compression mechanism 11*a* driven by the electrically powered mechanism 11*b* and the remainder of the compression process (point d' to point d) is undertaken by the auxiliary compression mechanism 6 driven by recovered power, changes in the specific volume $v_{cs}$ at the entrance of the auxiliary compression mechanism 6 are dependent on the pressure at point d'. Thus, even if the specific volumes at point c and point a are determined by the operating conditions, it is possible to adjust the specific volume $v_{cs}$ at the entrance of the auxiliary compression mechanism 6 for the purpose of rotational frequency matching. However, because driving of the auxiliary compression mechanism 6 is performed only by the expansion mechanism 5, power matching so as to supply compression power using recovered power is also required. There is a lower limit to the pressure at point b' in FIG. 5, and there is also a limit to the adjustment of the specific volume $v_{cs}$ at the entrance of the auxiliary compression mechanism 6 using the pressure at point b'. Consequently, after power has been balanced between the expansion mechanism 5 and the auxiliary compression mechanism 6, adjustment of the quantity of through flow Ge of the expansion mechanism 5 must be performed by bypassing refrigerant through the expansion valve 3 that is disposed in parallel with the expansion mechanism 5 in order to satisfy the conditions for rotational frequency matching in Mathematical Formula 3.

As explained above, because adjustment of rotational frequency using specific volume $v_{cs}$ at the entrance of the auxiliary compression mechanism 6 and adjustment of compression power by increasing pressure in the auxiliary compression mechanism 6 can be used in combination if a portion of the compression process of the refrigerating cycle is undertaken by the main compression mechanism 11*a* that is driven by the electrically powered mechanism 11*b* and the remainder of the compression process is undertaken by the auxiliary compression mechanism 6 of the scroll expander 1 that is driven by recovered power, decreases in recovery effects due to bypassing can be suppressed more than if all of the compression process of the refrigerating cycle is undertaken by the auxiliary compression mechanism 6 of the scroll expander 1.

Figure 7:
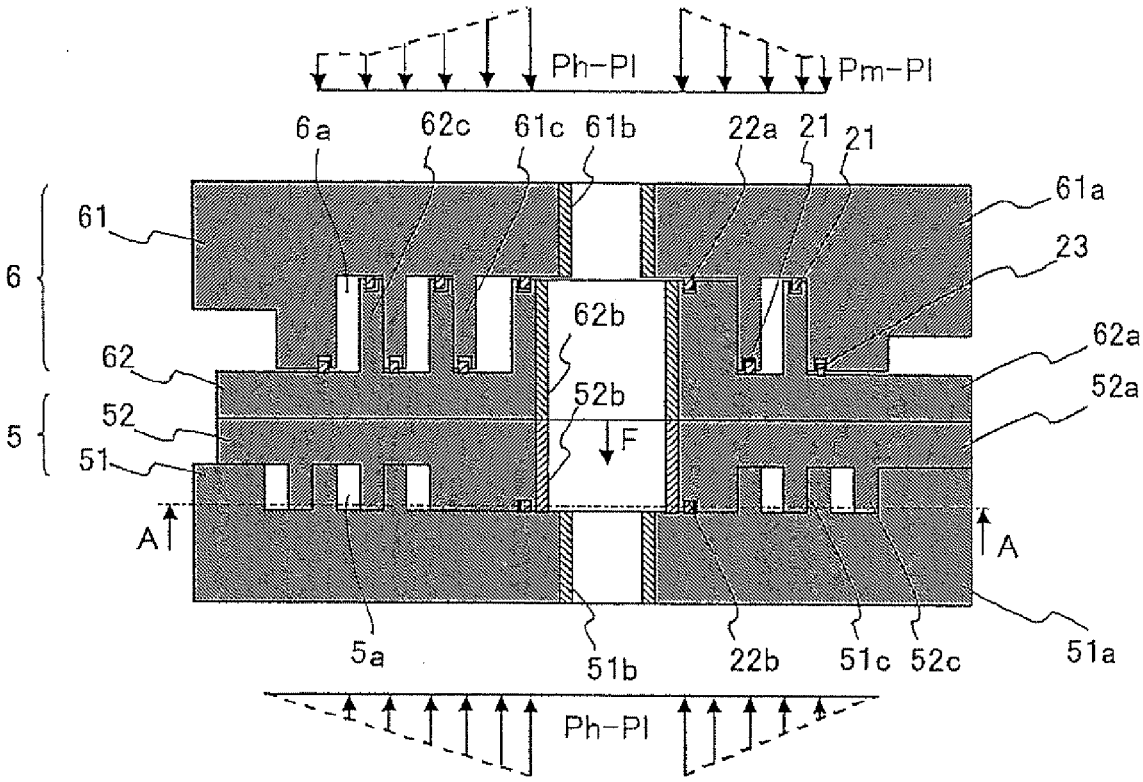
FIG. 7 is a general cross section of the expansion mechanism and the auxiliary compression mechanism of the scroll expander according to Embodiment 1 of the present invention.

FIG. 7 is a general cross section of the expansion mechanism and the auxiliary compression mechanism of the scroll expander according to Embodiment 1 of the present invention.

Tip seals 21 that partition off the auxiliary compression chamber 6*a* are mounted to the spiral teeth 61*c* and 62*c* of the auxiliary compression mechanism 6. An outer seal 23 is also disposed on the base plate 61*a* of the fixed scroll 61 of the auxiliary compression mechanism 6 outside the spiral tooth 61*c*. In addition, inner seals 22*a* and 22*b* are disposed outside the eccentric shaft bearing portions 52*b* and 62*b* of the orbiting scrolls 52 and 62. In the expansion mechanism 5, an outer portion of the base plate 51*a* of the fixed scroll 51 and an outer portion of the base plate 52*a* of the orbiting scroll 52 are configured so as to come into contact.

Figure 8:
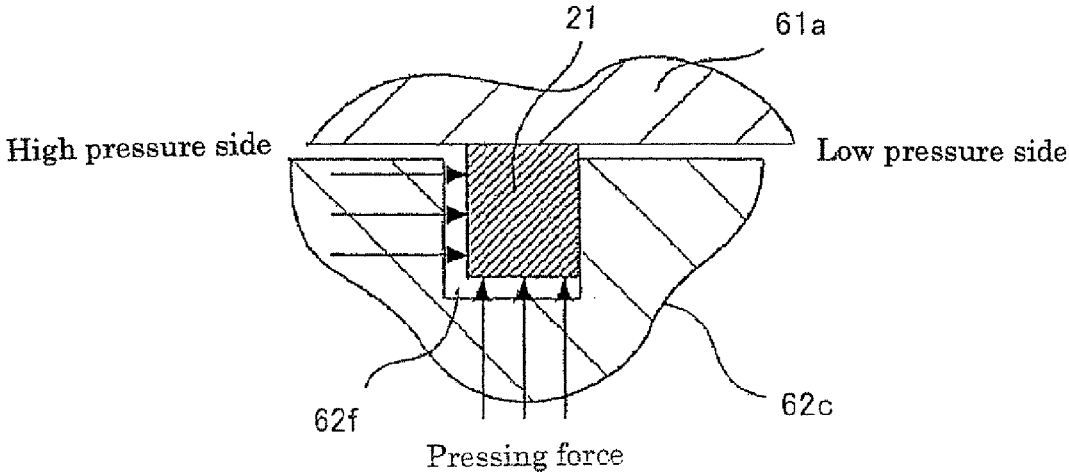
FIG. 8 is a cross section for explaining a general contact seal function of a tip seal.

FIG. 8 is a cross section in which a vicinity of a tip seal is enlarged in order to explain a contact seal function of the tip seals.

In FIG. 8, the tip seal 21 is pressed from the left and from below, which are on a high-pressure side, as indicated by the arrows, due to differential pressure on two sides of the auxiliary compression chamber 6*a* that are partitioned off. For this reason, the tip seal 21 is pressed against a wall to the right and a base plate above inside the tip seal groove 62*f* that is disposed for mounting the tip seal 21, forming a contact seal between the orbiting scroll 62 and the fixed scroll 61. Contact seal actions of the inner seals 22*a* and 22*b* and the outer seal 23 are also similar to the contact seal action of the tip seals 21.

In Embodiment 1 of the present invention, the expansion mechanism 5 undertakes an expansion process from a high pressure Ph (pressure at point c) to a low pressure Pl (pressure at point b), and the auxiliary compression mechanism 6 undertakes a compression process from an intermediate pressure Pm (pressure at point d') to the high pressure Ph (pressure at point d≈pressure at point c). For this reason, in the orbiting scrolls 52 and 62, the high pressure Ph acts on both a central portion of the expansion chamber 5*a* and a central portion of the auxiliary compression chamber 6*a*, and the low pressure Pl acts on an outer portion of the expansion chamber 5*a* and the intermediate pressure Pm on an outer portion of the auxiliary compression chamber 6*a*. Because the inside of the sealed vessel 10 is set to the low pressure Pl, the outer seal 23 is disposed on the base plate 61*a* of the fixed scroll 61 of the auxiliary compression mechanism 6 outside the spiral tooth 61*c* in order to seal off differential pressure between the outer portion of the auxiliary compression chamber 6*a* (Pm) and the inside of the sealed vessel 10 (Pl). The inner seals 22*a* and 22*b* are disposed outside the eccentric shaft bearing portions 52*b* and 62*b* of the orbiting scrolls 52 and 62 in order to seal off differential pressure between the central portion of the expansion chamber 5*a* (Ph) and the inside of the sealed vessel 10 (Pl) and between the central portion of the auxiliary compression chamber 6*a* (Ph) and the inside of the sealed vessel 10 (Pl).

If the inside of the sealed vessel 10 is set to the high pressure Ph, outer seals 23 must be disposed on an outer portion of the expansion mechanism 5, which is at the low pressure Pl, and an outer portion of the auxiliary compression mechanism 6, which is at the intermediate pressure Pm. If the inside of the sealed vessel 10 is set to the intermediate pressure Pm, an outer seal 23 must be disposed on an outer portion of the expansion mechanism 5, which is at the low pressure Pl, and inner seals 22*a* and 22*b* disposed on a central portion of the expansion mechanism 5 and a central portion of the auxiliary compression mechanism 6, which are at the high pressure Ph. Even if the inside of the sealed vessel 10 is set to the high pressure Ph or set to the intermediate pressure Pm, the number of seals is equal to or less than when the inside of the sealed vessel 10 is set to the low pressure Pl. However, if the inside of the sealed vessel 10 is set to the high pressure Ph or set to the intermediate pressure Pm, it is necessary to increase the thickness of the walls of the sealed vessel 10 more than if the inside of the sealed vessel 10 is set to the low pressure Pl in order to ensure pressure tolerance of the sealed vessel 10 relative to the high pressure Ph or to the intermediate pressure Pm, which is close to the high pressure Ph. Consequently, because the inner seals 22*a* and 22*b* are disposed at a central portion of the expansion mechanism 5 and a central portion of the auxiliary compression mechanism 6, and the outer seal 23 is disposed on the outer portion of auxiliary compression mechanism 6, the inside of the sealed vessel 10 can be set to the low pressure Pl, enabling manufacturing costs for the scroll expander 1 to be reduced.

As shown in FIG. 3(*a*), a center of the outer seal groove 61*g* of the outer seal 23 that separates the outer portion of the expansion chamber 5*a* that is at the low pressure Pl and the outer portion of the auxiliary compression chamber 6*a* that is at the intermediate pressure Pm is offset from the coordinate center of the spiral tooth 61*c* of the fixed scroll 61 toward a center of a circumscribing circle. Because of this, the diameter of the outer seal groove 61*g* is reduced so as to suppress the area over which the auxiliary compression mechanism 6 is subjected to the intermediate pressure Pm, preventing pressing forces on the tip surfaces of the spiral teeth 51*c* and 52*c* and the outer portions of the base plates 51*a* and 52*a* of the expansion mechanism 5 from becoming excessive.

In FIG. 7, the arrows represent distribution of axial differential pressure forces acting on the orbiting scrolls 52 and 62 using the low pressure Pl as a reference. The differential pressure forces at the central portions of the orbiting scrolls 52 and 62 are equal to Ph-Pl on both an expansion mechanism 5 side and an auxiliary compression mechanism 6 side. However, the differential pressure forces at outer portions of the orbiting scrolls 52 and 62 are zero on the expansion mechanism 5 side and Pm-Pl on the auxiliary compression mechanism 6 side. When these differential pressure forces are integrated, the orbiting scrolls 52 and 62 are subjected to a pressing force F directed downward in a direction of the shaft 8 (a force directed from the auxiliary compression mechanism 6 side toward the expansion mechanism 5 side), and the pressing force F is borne by the tip surfaces of the spiral teeth 51*c* and 52*c* and the base plate 51*a* and 52*a* of the expansion mechanism 5.

In scroll-type fluid machinery, in the case of both compressors and expanders, and in the case of both single-side spiral constructions that include a spiral tooth on only one surface of an orbiting scroll and double-sided spiral constructions that include spiral teeth on two surfaces of the orbiting scrolls, axial positions of the orbiting scrolls are determined by points that support axial force due to the pressure of the refrigerant, and gaps that correspond to assembly clearance arise on surfaces on opposite sides of the orbiting scrolls from the direction of pressure. For this reason, leakage may arise with the expansion chamber 5*a* or within the auxiliary compression chamber 6*a* where pressure differs.

In a scroll expander according to Embodiment 1, because the orbiting scrolls 52 and 62 are pressed together against the fixed scroll 51 of the expansion mechanism 5 by the pressing force F, gaps at the tips of the spiral teeth 51*c* and 52*c* of the expansion mechanism 5 are generally eliminated. Because of this, leakage from the tips of the spiral teeth 51*c* and 52*c* can be reduced in the expansion mechanism 5. In particular, because the differential pressure between the intermediate pressure Pm and the low pressure Pl is also increased if the high pressure Ph is an extremely high pressure, as in the case of carbon dioxide, adjustment of the diameter of the outer seal 23 in order to obtain the required pressing force F need only be small and can be achieved without enlarging outside diameter dimensions. On the other hand, gaps arise in the auxiliary compression mechanism 6 between the tip surface of the spiral tooth 62*c* of the orbiting scroll 62 and the base plate 61*a* of the fixed scroll 61 and between the base plate 62*a* of the orbiting scroll 62 and the tip surface of the spiral tooth 61*c* of the fixed scroll 61 of the auxiliary compression mechanism 6. However, because the tip seals 21 are mounted to the tips of the spiral teeth 61*c* and 62*c*, radial leakage outward from inside the spiral at the tips of the spiral teeth 61*c* and 62*c* is almost eliminated, enabling leakage to be limited to only circumferential leakage parallel to the spiral teeth 61*c* and 62*c* at sides of the tip seals 21.

In the expansion mechanism 5, because the outer portion of the base plate 51*a* of the fixed scroll 51 and the outer portion of the base plate 52*a* of the orbiting scroll 52 are configured so as to come into contact, the pressing force F can be supported over a wider area, suppressing absolute values of the surface pressure acting on the tooth ends of the spiral teeth 51*c* and 52*c* and amplitude of fluctuations during working pressure changes.

Now, if p is a spiral tooth pitch, and t is a spiral tooth thickness, then pivoting radii r of the expansion mechanism 5 and the auxiliary compression mechanism 6 have a relationship such as that shown in Mathematical Formula 4.

$$r = \frac{p}{2} - t \tag{4}$$

In Embodiment 1 of the present invention, the pivoting radii r are equal in the expansion mechanism 5 and the auxiliary compression mechanism 6. However, the spiral tooth thickness t is greater in the spiral teeth 51*c* and 52*c* of the expansion mechanism 5 than in the spiral teeth 61*c* and 62*c* of the auxiliary compression mechanism 6. The spiral tooth pitch p is also correspondingly greater in the spiral teeth 51*c* and 52*c* of the expansion mechanism 5 than in the spiral teeth 61*c* and 62*c* of the auxiliary compression mechanism 6. Because the spiral tooth thickness t is greater in the spiral teeth 51*c* and 52*c* of the expansion mechanism 5 than in the spiral teeth 61*c* and 62*c* of the auxiliary compression mechanism 6, strength can be ensured in the spiral teeth 51*c* and 52*c* of the expansion mechanism 5 where differential pressure before and after expansion is greater than differential pressure before and after compression in the auxiliary compression mechanism 6.

In a configuration such as that above, because a portion of the compression process of the refrigerating cycle is undertaken by the auxiliary compression mechanism 6 of the scroll expander 1, decreases in recovery effects due to bypassing can be suppressed, enabling a scroll expander that is efficient in a wide range of operating conditions to be achieved. Because the orbiting scrolls 52 and 62 are configured so as to be pressed against the fixed scroll 51 of the expansion mechanism 5 and the tip seals 21 are mounted to the spiral teeth 51*c* and 62*c* of the fixed scroll 61 and the orbiting scroll 62 of the auxiliary compression mechanism 6, leakage loss can be reduced.

Because the tip surfaces of the spiral teeth 51*c* and 52*c* and the outer portions of the base plates 51*a* and 52*a* of the expansion mechanism 5 are pressed together by performing compression from the intermediate pressure Pm to the high pressure Ph in the auxiliary compression mechanism 6, pressurization in the auxiliary compression mechanism 6 arises after activation, and an entire region of the auxiliary compression mechanism 6 from the outer portion to the central portion is at high pressure Ph before activation, making it possible to achieve a scroll expander 1 having superior activation since tooth end pushing in the expansion mechanism 5 becomes more reliable.

Embodiment 2

Figure 9:
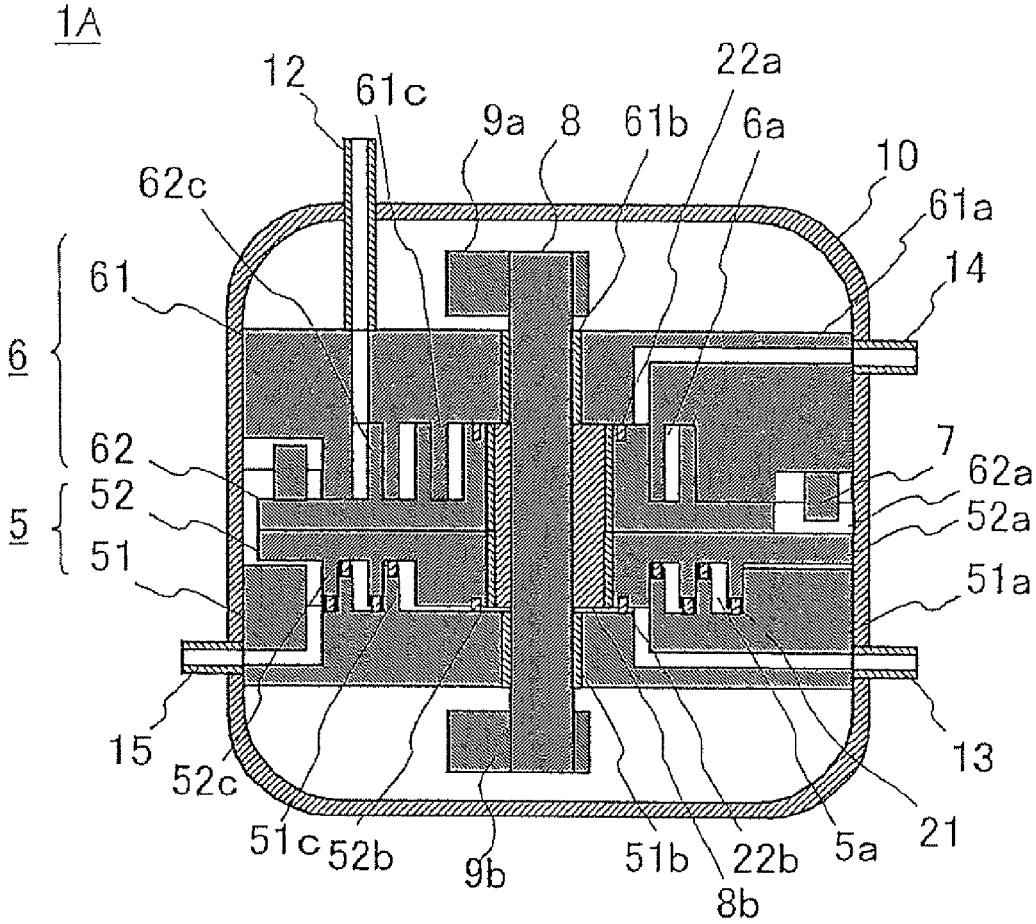
FIG. 9 is a longitudinal section showing configuration of a scroll expander according to Embodiment 2 of the present invention.

FIG. 9 is a longitudinal section showing configuration of a scroll expander according to Embodiment 2 of the present invention.

In Embodiment 1, tip seals 21 were mounted to tips of spiral teeth 61*c* and 62*c* of an auxiliary compression mechanism 6, and orbiting scrolls 52 and 62 were configured so as to be pressed against a fixed scroll 51 of an expansion mechanism 5. In a scroll expander 1A according to Embodiment 2 of the present invention, as shown in FIG. 9, tip seals 21 are mounted to tips of spiral teeth 51*c* and 52*c* of an expansion mechanism 5, and orbiting scrolls 52 and 62 are configured so as to be pressed against a fixed scroll 61 of an auxiliary compression mechanism 6. Moreover, tip seals 21 are not mounted to tips of spiral teeth 61*c* and 62*c* of the auxiliary compression mechanism 6. The rest of the configuration and functions of the scroll expander 1A according to Embodiment 2 of the present invention are similar to those of the scroll expander 1 shown in Embodiment 1.

Figure 10:
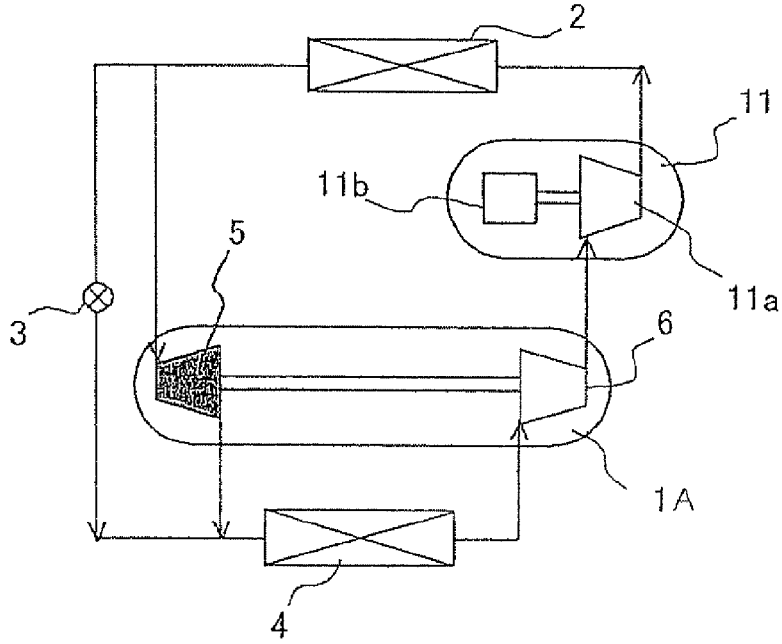
FIG. 10 is a circuit diagram showing basic configuration of a refrigerating cycle using the scroll expander according to Embodiment 2 of the present invention.

FIG. 10 is a circuit diagram showing basic configuration of a refrigerating cycle using the scroll expander according to Embodiment 2 of the present invention. In Embodiment 2 of the present invention, a refrigerant having a high-pressure side that is supercritical, such as carbon dioxide, is assumed.

In FIG. 10, a main compression mechanism 11*a* that is driven by an electrically powered mechanism 11*b* of a main compressor 11 is installed in a stage subsequent to the auxiliary compression mechanism 6 that is driven by the expansion mechanism 5 of the scroll expander 1A. A gas cooler 2 that cools the refrigerant is installed in a stage subsequent to the main compression mechanism 11*a*, and the expansion mechanism 5 of the scroll expander 1A and an expansion valve 3 are disposed in parallel in a stage subsequent to the gas cooler 2. On the other hand, an evaporator 4 that heats the refrigerant is installed in a stage preceding the auxiliary compression mechanism 6.

Refrigerant that has been pressurized in the auxiliary compression mechanism 6 that is driven by the expansion mechanism 5 of the scroll expander 1A is pressurized further by the main compression mechanism 11*a* that is driven by the electrically powered mechanism 11*b* of the main compressor 11. Refrigerant that has been pressurized in the main compression mechanism 11*a* is cooled by the gas cooler 2, then a portion is sent to the expansion mechanism 5 of the scroll expander 1A to be expanded and decompressed. The expansion valve 3 is disposed in parallel with the expansion mechanism 5 of the scroll expander 1A in order to adjust quantities of flow passing through the expansion mechanism 5 and to ensure differential pressure at startup, and the remaining refrigerant is sent to the expansion valve 3 to be expanded and decompressed. In the expansion mechanism 5, the refrigerant expands isentropically, and expansion power is transmitted from the expansion mechanism 5 through the main shaft 8 to the auxiliary compression mechanism 6 and is used for auxiliary compression work. Refrigerant that has been expanded in the expansion mechanism 5 is heated by the evaporator 4, then returns to the auxiliary compression mechanism 6 of the scroll expander 1A.

Figure 11:
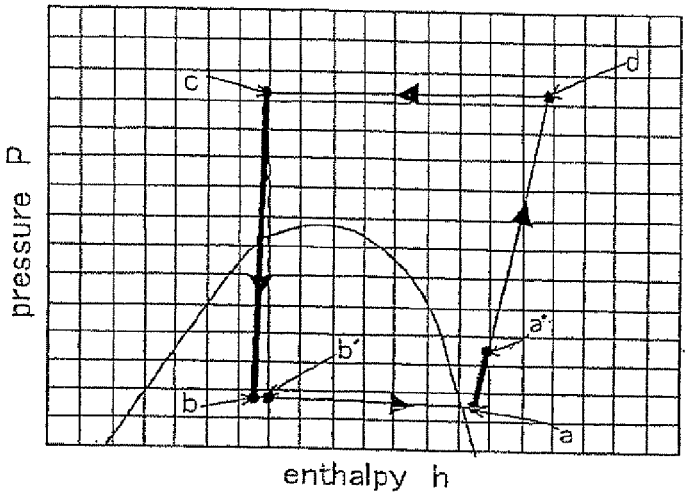
FIG. 11 is a Mollier diagram showing changes in quantities of state of a refrigerant in the refrigerating cycle using the scroll expander according to Embodiment 2 of the present invention.

FIG. 11 is a Mollier diagram showing changes in quantities of state of a refrigerant in the refrigerating cycle using the scroll expander according to Embodiment 2 of the present invention. In FIG. 11, the vertical axis is pressure, and the horizontal axis is enthalpy.

As shown in FIG. 11, refrigerant that has been cooled from point d to point c by exchanging heat in the gas cooler 2, changes from point c to point b due to isentropic expansion in the expansion mechanism 5. After expansion, heat is exchanged in the evaporator 4, and refrigerant gas that has been heated from point b to point a is compressed from point a to point a' by the auxiliary compression mechanism 6 of the scroll expander 1A, then compressed from point a' to point d by the main compression mechanism 11*a* of the main compressor 11. As described above, in Embodiment 2 of the present invention, a portion of the compression process of the refrigerating cycle is undertaken by the compression mechanism 11*b* of the main compressor 11, and a remainder of the compression process is undertaken by the auxiliary compression mechanism 6 of the scroll expander 1A. Compression power proportionate to a difference in enthalpy $h_a'$-$h_a$ in the auxiliary compression mechanism 6 is provided by recovered power proportionate to $h_b'$-$h_b$.

In Embodiment 2 of the present invention, a portion of the compression process of the refrigerating cycle is also undertaken by the main compression mechanism 11*a* driven by the electrically powered mechanism 11*b* and the remainder is undertaken by the auxiliary compression mechanism 6 of the scroll expander 1A driven by recovered power. Because of this, decreases in recovery effects due to bypassing can be suppressed proportionately more than if all of the compression process of the refrigerating cycle is undertaken by the auxiliary compression mechanism 6 of the scroll expander 1A since adjustment of compression power by increasing pressure in the auxiliary compression mechanism 6 is possible.

Figure 12:
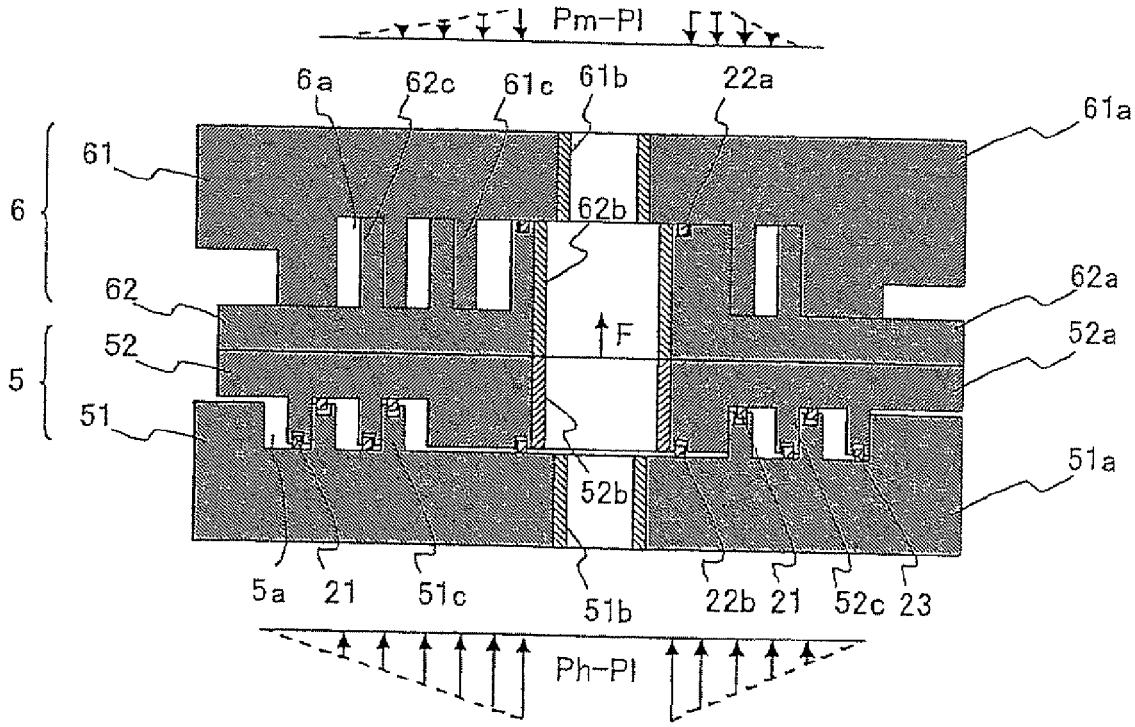
FIG. 12 is a general cross section of the expansion mechanism and an auxiliary compression mechanism of the scroll expander according to Embodiment 2 of the present invention.

FIG. 12 is a general cross section of the expansion mechanism and an auxiliary compression mechanism of the scroll expander according to Embodiment 2 of the present invention.

Tip seals 21 that partition off the expansion chamber 5*a* are mounted to the spiral teeth 51*c* and 52*c* of the expansion mechanism 5. Inner seals 22*a* and 22*b* are installed outside the eccentric shaft bearing portions 52*b* and 62*b* of the orbiting scrolls 52 and 62. In the auxiliary compression mechanism 6, an outer portion of the base plate 61*a* of the fixed scroll 61 and an outer portion of the base plate 62*a* of the orbiting scroll 62 are configured to come into contact.

In Embodiment 2 of the present invention, the expansion mechanism 5 undertakes an expansion process from a high pressure Ph (pressure at point c) to a low pressure Pl (pressure at point b), and the auxiliary compression mechanism 6 undertakes a compression process from the low pressure Pl (pressure at point a≈pressure at point b) to an intermediate pressure Pm (pressure at point a'). For this reason, the high pressure Ph acts on the central portion of the expansion chamber 5*a*, and the intermediate pressure Pm on a central portion of the auxiliary compression chamber 6*a*, and the low pressure Pl acts on both the outer portion of the expansion chamber 5*a* and the outer portion of the auxiliary compression chamber 6*a*. Because the inner seals 22*a* and 22*b* are installed outside the eccentric shaft bearing portions 52*b* and 62*b* of the orbiting scrolls 52 and 62, differing pressures can be separated at the central portion of the expansion chamber 5*a* and the central portion of the auxiliary compression chamber 6*a*. Because the pressures that act on the outer portion of the expansion chamber 5*a* and the outer portion of the auxiliary compression chamber 6*a* are both equal to the low pressure Pl, it is not necessary to separate the pressures, and outer seals 23 are not disposed on an expansion mechanism 5 side or on an auxiliary compression mechanism 6 side. In addition, because the inner seals 22*a* and 22*b* are disposed outside the eccentric shaft bearing portions 52*b* and 62*b* of the orbiting scrolls 52 and 62, the inside of the sealed vessel 10 can be set to the low pressure Pl, and it is no longer necessary to increase the thickness of the walls of the sealed vessel 10 as much as if the inside of the sealed vessel 10 is at the high pressure Ph or the intermediate pressure Pm, enabling manufacturing costs for the scroll expander 1A to be reduced.

In FIG. 12, the arrows represent distribution of axial differential pressure forces acting on the orbiting scrolls 52 and 62 using the low pressure Pl as a reference. The differential pressure forces at outer portions of the orbiting scrolls 52 and 62 are zero on both the expansion mechanism 5 side and the auxiliary compression mechanism 6 side. However, the differential pressure forces at inner portions of the orbiting scrolls 52 and 62 are Ph-Pl on the expansion mechanism 5 side and Pm-Pl on the auxiliary compression mechanism 6 side. When these differential pressure forces are integrated, the orbiting scrolls 52 and 62 are subjected to a pressing force F directed upward in a direction of the shaft 8 (a force directed from the expansion mechanism 5 side toward the auxiliary compression mechanism 6 side), and the pressing force F is borne by the tip surfaces of the spiral teeth 61*c* and 62*c* and the base plate 61*a* and 62*a* of the auxiliary compression mechanism 6. In the auxiliary compression mechanism 6, in particular, because the outer portion of the base plate 61*a* of the fixed scroll 61 and the outer portion of the base plate 62*a* of the orbiting scroll 62 are configured so as to come into contact, the pressing force F can be supported over a wider area, preventing the surface pressure acting on the tooth ends of the spiral teeth 61*c* and 62*c* from becoming excessive.

In a scroll expander according to Embodiment 2, because the orbiting scrolls 52 and 62 are pressed together against the fixed scroll 61 of the auxiliary compression mechanism 6, gaps at the tips of the spiral teeth 61*c* and 62*c* of the auxiliary compression mechanism 6 are generally eliminated. Because of this, leakage from the tips of the spiral teeth 61*c* and 62*c* can be reduced in the auxiliary compression mechanism 6. In particular, because the differential pressure between the expansion mechanism 5 side and the auxiliary compression mechanism 6 side is increased at the central portion if the high pressure Ph is an extremely high pressure, as in the case of carbon dioxide, the tooth ends of the spiral teeth 61*c* and 62*c* can be reliably pressed down even if there is no differential pressure at the outer portions where the pressure receiving area is great and both are at the low pressure Pl. On the other hand, gaps arise in the expansion mechanism 5 between the tip surfaces of the spiral tooth 52*c* of the orbiting scroll 52 and the base plate 51*a* of the fixed scroll 51 and between the base plate 52*a* of the orbiting scroll 52 and the tip surfaces of the spiral tooth 51*c* of the fixed scroll 51 of the expansion mechanism 5. However, because the tip seals 21 are mounted to the tips of the spiral teeth 51*c* and 52*c*, radial leakage at the tips of the spiral teeth 51*c* and 52*c* is generally eliminated, enabling leakage to be limited to only circumferential leakage parallel to the spiral teeth 51*c* and 52*c* at sides of the tip seals 21, and also ensuring activation.

In a configuration such as that above, because a portion of the compression process of the refrigerating cycle is undertaken by the auxiliary compression mechanism 6 of the scroll expander 1A, decreases in recovery effects due to bypassing can be suppressed, enabling a scroll expander that is efficient in a wide range of operating conditions to be achieved. Because the orbiting scrolls 52 and 62 are configured so as to be pressed against the fixed scroll 61 of the auxiliary compression mechanism 6 and the tip seals 21 are mounted to the spiral teeth 51*c* and 52*c* of the fixed scroll 51 and the orbiting scroll 52 of the expansion mechanism 5, leakage loss can be reduced.

Because outer portions of the spiral teeth 51*c*, 52*c*, 61*c*, and 62*c* of both the expansion mechanism 5 and the auxiliary compression mechanism 6 are all at the low pressure Pl, large-diameter outer seals 23 are not required, enabling manufacturing costs for the scroll expander 1A to be reduced.

The invention claimed is:

1. A refrigeration system comprising:

a main compression mechanism compressing a refrigerant and driven by an electrically powered mechanism;

a gas cooler cooling the refrigerant;

an evaporator evaporating the refrigerant;

an expansion mechanism, including a first orbiting scroll and a first fixed scroll, that recovers power by expanding the refrigerant, wherein each of the first orbiting scroll and the first fixed scroll includes a spiral tooth, and the main compression mechanism, the gas cooler, the evaporator, and the expansion mechanism, together, provide a refrigeration cycle;

an auxiliary compression mechanism, including a second orbiting scroll and a second fixed scroll, that compresses the refrigerant using power recovered by the expansion mechanism, wherein each of the second orbiting scroll and the second fixed scroll includes a spiral tooth, the auxiliary compression mechanism and the main compression mechanism provide a compression process of the refrigeration cycle, and the first orbiting scroll and the second orbiting scroll have abutting surfaces free of spiral teeth and at which the first orbiting scroll and the second orbiting scroll are integrated;

tip seals mounted only on the spiral teeth of the first orbiting scroll and the first fixed scroll of the expansion mechanism: and a sealed vessel in which the expansion mechanism and the auxiliary compression mechanism are located, wherein the pressure within the sealed vessel is equal to the pressure of the refrigerant expanded by the expansion mechanism, the refrigerant compressed by the auxiliary compression mechanism is sent to the main compression mechanism so that the refrigerant presses the first and second orbiting scrolls that are integrated against the second fixed scroll, and no outer seals are disposed outside the spiral teeth of the first fixed scroll and the second fixed scroll.

2. The refrigeration system according to claim 1, wherein spiral tooth thickness is larger in said expansion mechanism than in said auxiliary compression mechanism.

3. The refrigeration system according to claim 1, wherein an outer portion of the second orbiting scroll and an outer portion of the second fixed scroll, on which no tip seals are mounted, are in contact with each other.

4. The refrigeration system according to claim 1, wherein the refrigerant is carbon dioxide.

5. A refrigeration system comprising:

a main compression mechanism compressing a refrigerant and driven by an electrically powered mechanism;

a gas cooler cooling the refrigerant;

an evaporator evaporating the refrigerant;

an expansion mechanism, including a first orbiting scroll and a first fixed scroll, that recovers power by expanding the refrigerant, wherein each of the first orbiting scroll and the first fixed scroll includes a spiral tooth, and the main compression mechanism, the gas cooler, the evaporator, and the expansion mechanism, together, provide a refrigeration cycle;

an auxiliary compression mechanism, including a second orbiting scroll and a second fixed scroll, that compresses the refrigerant using power recovered by the expansion mechanism, wherein each of the second orbiting scroll and the second fixed scroll includes a spiral tooth, the auxiliary compression mechanism and the main compression mechanism provide a compression process of the refrigeration cycle, and the first orbiting scroll and the second orbiting scroll have abutting surfaces free of spiral teeth and at which the first orbiting scroll and the second orbiting scroll are integrated;

tip seals mounted only on the spiral teeth of the second orbiting scroll and the second fixed scroll of the auxiliary compression mechanism; and a sealed vessel in which the expansion mechanism and the auxiliary compression mechanism are located, wherein the pressure within the sealed vessel is equal to the pressure of the refrigerant expanded by the expansion mechanism, an outer seal is disposed outside the spiral tooth of the second fixed scroll, and the auxiliary compression mechanism further compresses the refrigerant that has been compressed by the main compression mechanism so that the refrigerant presses the first and second orbiting scrolls that are integrated against the first fixed scroll.

6. The refrigeration according to claim 5, wherein spiral tooth thickness is larger in said expansion mechanism than in said auxiliary compression mechanism.

7. The refrigeration system according to claim 5, wherein an outer portion of the first orbiting scroll and an outer portion of the first fixed scroll, on which no tip seals are mounted, are in contact with each other.

8. The refrigeration system according to claim 5, wherein the refrigerant is carbon dioxide.

* * * * *